US011562620B2

(12) United States Patent
Jones

(10) Patent No.: US 11,562,620 B2
(45) Date of Patent: Jan. 24, 2023

(54) BONUS BET SYSTEM AND METHOD

(71) Applicant: Mark Hamilton Jones and Sheryle Lynn Jones Family Trust dated Nov. 7, 2013, Gardnerville, NV (US)

(72) Inventor: Mark H. Jones, Gardnerville, NV (US)

(73) Assignees: Mark Hamilton Jones, Gardnerville, NV (US), Family Trust Dated Nov. 7, 2013; Sheryle Lynn Jones, Gardnerville, NV (US), Family Trust Dated Nov. 7, 2013

( * ) Notice: Subject to any disclaimer, the term of this patent is extended or adjusted under 35 U.S.C. 154(b) by 59 days.

(21) Appl. No.: 16/597,241

(22) Filed: Oct. 9, 2019

(65) Prior Publication Data

US 2020/0111281 A1 Apr. 9, 2020

Related U.S. Application Data

(60) Provisional application No. 62/743,249, filed on Oct. 9, 2018.

(51) Int. Cl.
*G07F 17/32* (2006.01)
*A63F 3/00* (2006.01)

(52) U.S. Cl.
CPC ..... *G07F 17/322* (2013.01); *A63F 3/00157* (2013.01); *G07F 17/3244* (2013.01); *G07F 17/3262* (2013.01)

(58) Field of Classification Search
CPC ..... G07F 17/322; G07F 17/3244; G07F 17/3262; G07F 17/32; A63F 5/00; A63F 5/046; A63F 5/04; A63F 5/045; A63F 5/02; A63F 5/0094
USPC ..... 463/17
See application file for complete search history.

(56) References Cited

U.S. PATENT DOCUMENTS 1,431,170 A * 10/1922 Maier ..... A63F 5/046 273/142 K
2,210,201 A * 8/1940 Draper ..... A63F 3/00069 273/278
2,722,425 A * 11/1955 Gazelle ..... A63F 5/04 273/285
6,217,022 B1 * 4/2001 Astaneha ..... A63F 5/043 273/274
6,663,106 B1 * 12/2003 Cosmi ..... G07F 17/3262 273/142 E (Continued)

*Primary Examiner* — Chase E Leichliter
(74) *Attorney, Agent, or Firm* — Dickinson Wright PLLC

(57) ABSTRACT

Disclosed is a bonus bet system for use with a roulette game or other games as it relates to a player placing a bonus bet on an outcome of the roulette game or the other games. The bonus bet system may include a first outcome determination device, such as a wheel, and a second outcome determination device, such as a second wheel. The first outcome determination device includes a first plurality of outcomes displayed thereon, and the second outcome determination device has a second plurality of outcomes displayed thereon. The first and second pluralities of outcomes may be the same, or the second plurality of outcomes may be a subset of the first plurality of outcomes. When the outcome of the second outcome determination device corresponds to the outcome of the first outcome determination device, a bonus may be applied to successful wagers on the first outcome.

20 Claims, 3 Drawing Sheets

(56) References Cited

U.S. PATENT DOCUMENTS 6,743,094 B2 * 6/2004 Johnson ..... G07F 17/3262 463/20
6,921,072 B2 * 7/2005 Hughes-Watts .... G07F 17/3262 273/142 E
7,216,867 B1 * 5/2007 Luciano ..... G07F 17/32 273/138.2
7,425,177 B2 * 9/2008 Rodgers ..... G07F 17/34 463/16
7,571,910 B1 * 8/2009 Launzel ..... G07F 17/3258 D21/375
7,674,172 B2 * 3/2010 Miltenberger ..... A63F 5/007 273/142 E
7,762,883 B2 * 7/2010 Griswold ..... G07F 17/3213 273/138.2
7,946,914 B2 * 5/2011 Vancura ..... G07F 17/3267 463/16
8,100,754 B2 * 1/2012 Bigelow, Jr. ..... G07F 17/32 463/16
9,613,485 B2 * 4/2017 Barragan ..... G07F 17/3213
10,769,892 B2 * 9/2020 Abrahamson ..... G07F 17/3293
2002/0037765 A1 * 3/2002 Johnson ..... G07F 17/3211 463/17
2003/0094752 A1 * 5/2003 Mathews ..... A63F 5/04 273/142 E
2004/0061285 A1 * 4/2004 Hughes-Watts ..... A63F 5/00 273/143 R
2004/0077398 A1 * 4/2004 Jarvis ..... G07F 17/34 463/17
2004/0198484 A1 * 10/2004 Johnson ..... G07F 17/3211 463/17
2005/0167912 A1 * 8/2005 Sokolov ..... G07F 17/3213 273/143 R
2006/0009278 A1 * 1/2006 Vancura ..... G07F 17/3244 463/25
2006/0178191 A1 * 8/2006 Ellis ..... A63F 5/00 463/20
2006/0237905 A1 * 10/2006 Nicely ..... A63F 5/04 273/274
2007/0120320 A1 * 5/2007 Miltenberger ..... A63F 5/007 273/143 R
2007/0135203 A1 * 6/2007 Nicely ..... A63F 5/00 463/17
2008/0139280 A1 * 6/2008 Inamura ..... G07F 17/3202 463/17
2008/0214264 A1 * 9/2008 Griswold ..... A63F 5/00 463/17
2008/0248853 A1 * 10/2008 Kido ..... G07F 17/3244 463/17
2009/0042635 A1 * 2/2009 Carbonaro ..... A63F 5/00 463/17
2010/0102507 A1 * 4/2010 Bontempo ..... A63F 5/00 273/309
2010/0120487 A1 * 5/2010 Walker ..... G07F 17/322 463/25
2010/0227665 A1 * 9/2010 Nicely ..... G07F 17/3288 273/142 E
2011/0006477 A1 * 1/2011 Miller ..... G07F 17/34 463/16
2012/0088565 A1 * 4/2012 Miller ..... G07F 17/32 463/17
2012/0112408 A1 * 5/2012 Poon ..... A63F 5/043 273/142 R
2012/0115562 A1 * 5/2012 Kido ..... G07F 17/329 463/17
2012/0202575 A1 * 8/2012 Matsuno ..... G07F 17/3216 463/17
2012/0238343 A1 * 9/2012 Perrone ..... G07F 17/3262 273/274
2013/0059638 A1 * 3/2013 Nicely ..... G07F 17/34 463/17
2013/0059647 A1 * 3/2013 Nicely ..... G07F 17/326 463/25
2013/0316781 A1 * 11/2013 Pececnik ..... G07F 17/32 463/17
2014/0038680 A1 * 2/2014 Pececnik ..... G07F 17/3213 463/19
2014/0210164 A1 * 7/2014 Macdonald ..... A63F 3/00157 273/142 H
2014/0221073 A1 * 8/2014 Pockaj ..... G07F 17/326 463/19
2015/0321081 A1 * 11/2015 Sorge ..... A63F 5/043 273/142 E
2016/0055716 A1 * 2/2016 Young-Czyzewski ..... G07F 17/3211 463/17
2016/0093139 A1 * 3/2016 Zielinski ..... G07F 17/3244 463/20
2016/0175699 A1 * 6/2016 Smith ..... A63F 5/0005 273/142 E
2016/0189470 A1 * 6/2016 Barragan ..... G07F 17/322 463/20
2016/0300454 A1 * 10/2016 Uss ..... G07F 17/3288
2016/0328905 A1 * 11/2016 Kohl ..... G07F 17/3262
2017/0092037 A1 * 3/2017 Snow ..... G07F 17/3244
2017/0165562 A1 * 6/2017 Fitoussi ..... A63F 5/0047
2019/0130702 A1 * 5/2019 Hamud ..... G07F 17/3288
2019/0213837 A1 * 7/2019 Pawlak ..... G07F 17/3272

* cited by examiner

BONUS BET SYSTEM AND METHOD

CROSS-REFERENCE TO RELATED APPLICATIONS

This application claims the benefit of U.S. Provisional Patent Application No. 62/743,249, titled "Bonus Bet Apparatus," and filed on Oct. 9, 2018, the entire content of which is hereby incorporated by reference herein.

FIELD

This disclosure relates to casino games, and more particularly, to the determination of an outcome and payout for casino games, such as roulette and other games.

BACKGROUND

Roulette and other casino games typically involve wagering by players, with a payout being returned to the player in the event that the player's wager is successful, with the amount of the payout commensurate with the statistical odds that the outcome on which the player wagered will be the resulting outcome.

In traditional roulette games, the payout for particular outcomes are predetermined and often printed on the table where players place their bets. The odds for a roulette game therefore do not change over time. Accordingly, players may not be motivated to place bets on different outcomes at different times. Accordingly, players may not be motivated to partake in a game of roulette at any particular time, because the experience remains the same.

Accordingly, improvements can be made to the experience of roulette games and other games of chance.

SUMMARY

In one aspect, a bonus bet system for use with a roulette game or other games of chance is provided, the system comprising: a first outcome determination device, the first outcome determination device configured to determine a first winning outcome from a first plurality of potential winning outcomes; a first wagering device, the first wagering device configured to receive wagers corresponding to one or more of the first plurality of potential winning outcomes; a second outcome determination device, the second outcome determination device configured to determine a second winning outcome from a second plurality of potential winning outcomes; wherein the first plurality of winning outcomes includes at least the second plurality of winning outcomes; wherein the first winning outcome includes a first payout corresponding to a wager received at the first wagering device corresponding to the first winning outcome; wherein the first winning outcome is increased when the second winning outcome includes at least the first winning outcome.

In one aspect, the first outcome determination device is a first wheel.

In one aspect, the second outcome determination device is a second wheel.

In one aspect, the second outcome determination device is disposed on the first wheel.

In one aspect, the second outcome determination device is a pointer configured to point to an outcome displayed on the first wheel.

In one aspect, the first wheel includes a first plurality of colors and numbers displayed thereon, wherein the first plurality of outcomes includes the plurality of colors and numbers.

In one aspect, the second wheel includes a second plurality of colors and numbers displayed thereon, where the second plurality of outcomes is the second plurality of colors and numbers, and the second plurality of outcomes is the same as the first plurality of outcomes.

In one aspect, the second wheel includes a second plurality of colors and numbers displayed thereon, where the second plurality of outcomes is the second plurality of colors and numbers, and the second plurality of outcomes is different than the first plurality of outcomes, wherein some of the first plurality of outcomes are excluded from the second plurality of outcomes.

In one aspect, the first plurality of colors and numbers includes a first range of numbers, and the second plurality of outcomes includes a second range of numbers that is less than the first range of numbers.

In one aspect, the first wagering device is a table including a display of the first plurality of outcomes.

In one aspect, a payout for the first winning outcome remains the same when the second winning outcome does not include the first winning outcome.

In one aspect, the second winning outcome is determinable prior to the first winning outcome.

In one aspect, the first plurality of outcomes is variable, and the first outcome determination device includes a variable display of the first plurality of outcomes.

In another aspect, a method of determining a payout for a roulette game or a game of chance is provided, the method including the steps of: providing a first wagering device, the first wagering device having a first plurality of outcomes displayed thereon; receiving a first wager from a player at the first wagering device, wherein the first wager includes one or more of the first plurality of outcomes; determining a first winning outcome via a first outcome determination device, wherein the first outcome determination device includes the first plurality of outcomes, wherein the first winning outcome corresponds to at least one of the first plurality of outcomes; determining a second winning outcome via a second outcome determination device, wherein the second outcome determination device includes a second plurality of outcomes, wherein the second winning outcome corresponds to at least one of the second plurality of outcomes; wherein the first plurality of outcomes includes at least the second plurality of outcomes; determining whether the first wager corresponds to the first winning outcome; determining whether the second winning outcome corresponds to the first winning outcome; providing a first payout to a player when the first wager corresponds to the first outcome; providing a bonus to the player when the second winning outcome corresponds to the first winning outcome.

In one aspect, the second plurality of outcomes is a subset of the first plurality of outcomes.

In one aspect, the first outcome determination device is a first wheel having the first plurality of outcomes displayed thereon and the second outcome determination device is a second wheel having the second plurality of outcomes displayed thereon.

In one aspect, the first and second wheel are the same wheel.

In one aspect, the second plurality of outcomes includes one or more outcomes that occur more often.

In one aspect, the first wager is received prior to determining the second winning outcome.

In one aspect, the second winning outcome is determined prior to determining the first winning outcome.

DRAWINGS

The drawings described herein are for illustrative purposes only of selected aspects and not all possible or anticipated implementations thereof, and are not intended to limit the scope of the present disclosure.

DETAILED DESCRIPTION

In the following description, details are set forth to provide an understanding of the present disclosure. In some instances, certain systems, structures and techniques have not been described or shown in detail in order not to obscure the disclosure.

In general, the present disclosure relates to a bonus bet apparatus (i.e., device), for use with a roulette game or other games (e.g., card games, slot machines, sports, activities, events, occurrences), as it relates to a player placing a bonus bet on an outcome of the roulette game or the other games, or a portion thereof.

Figure 1:
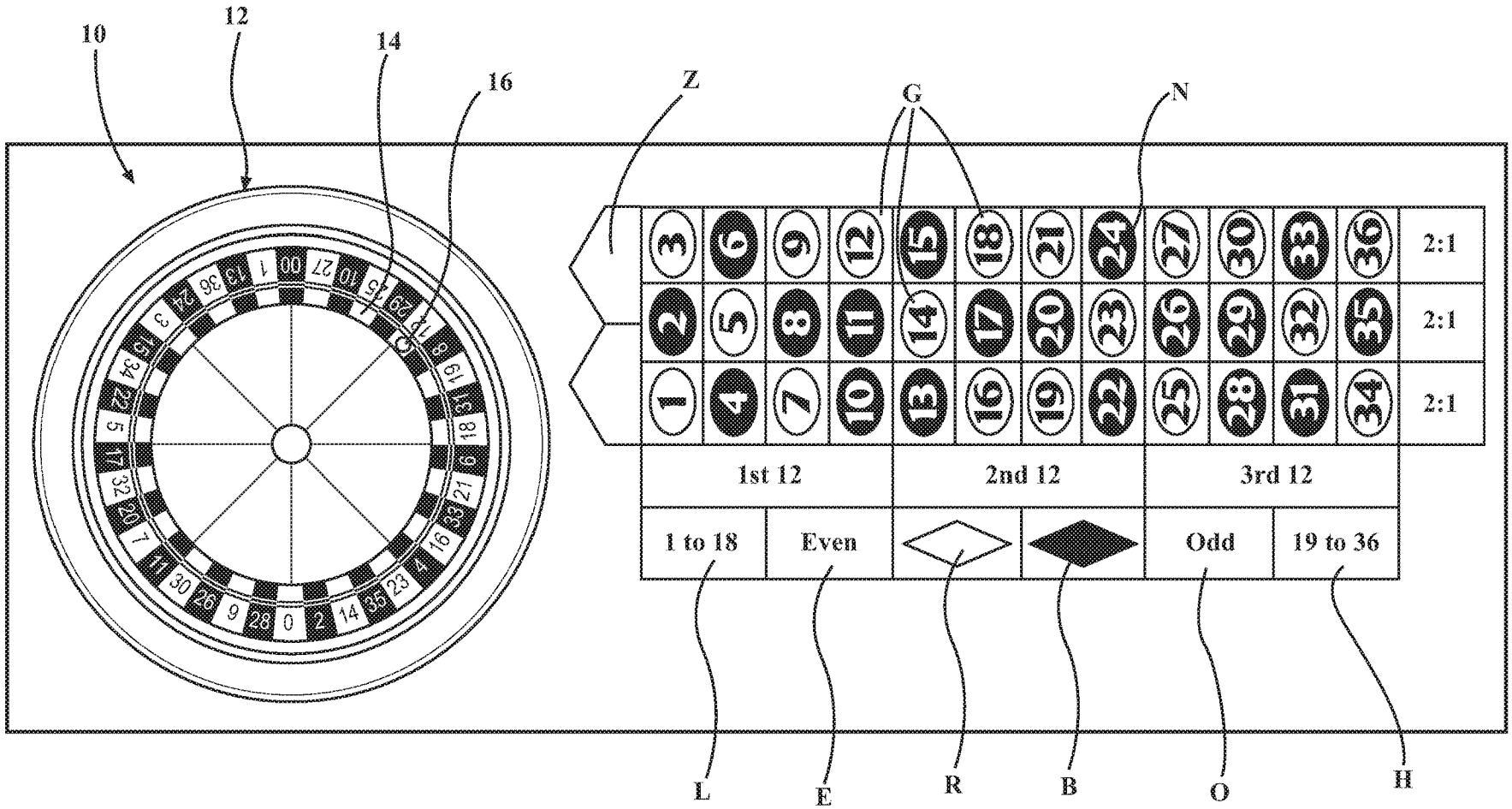
FIG. 1 is a top view of an exemplary roulette table, according to aspects of the disclosure.
Figure 2:
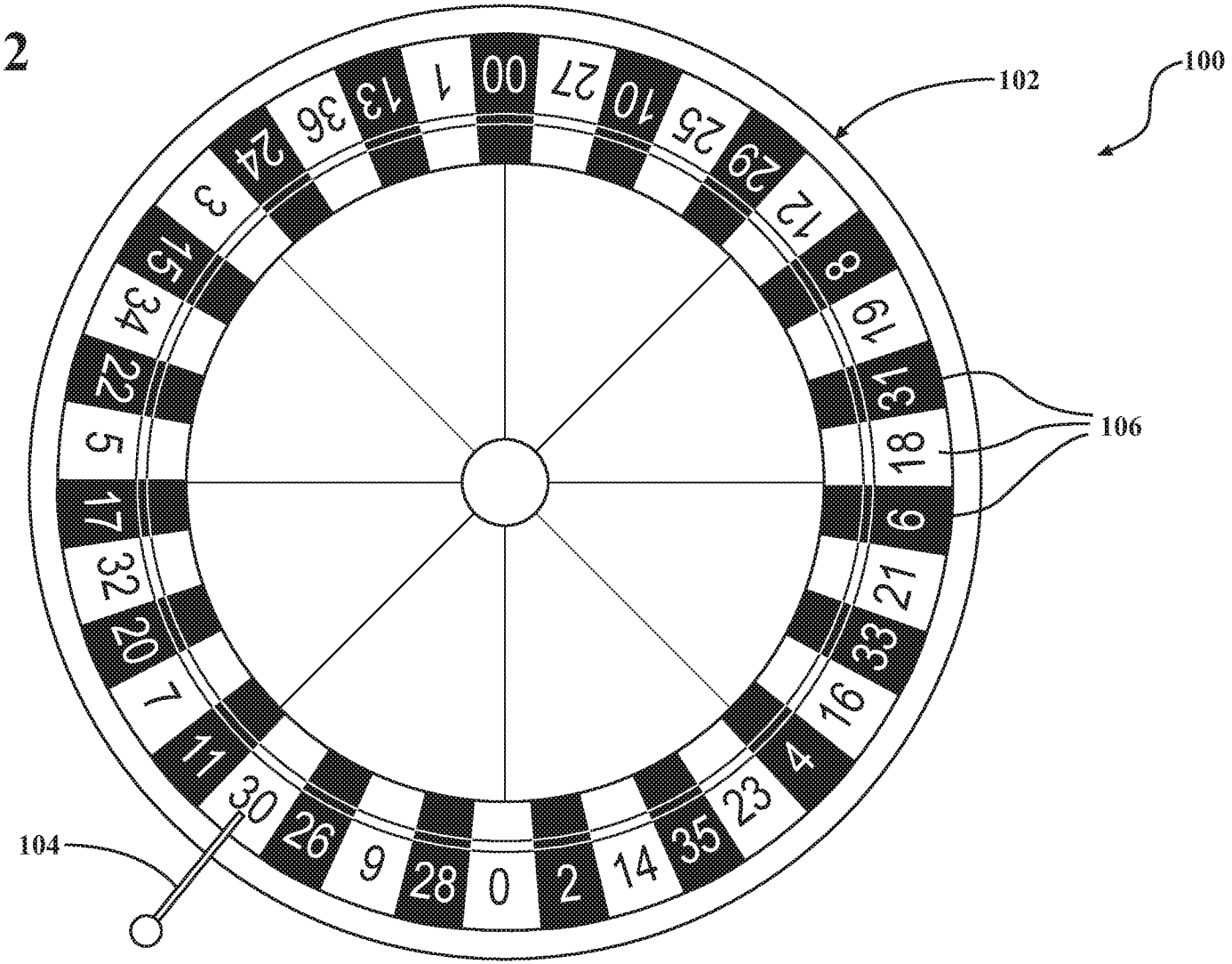
FIG. 2 is a top view of a bonus wheel, according to aspects of the disclosure.
Figure 3:
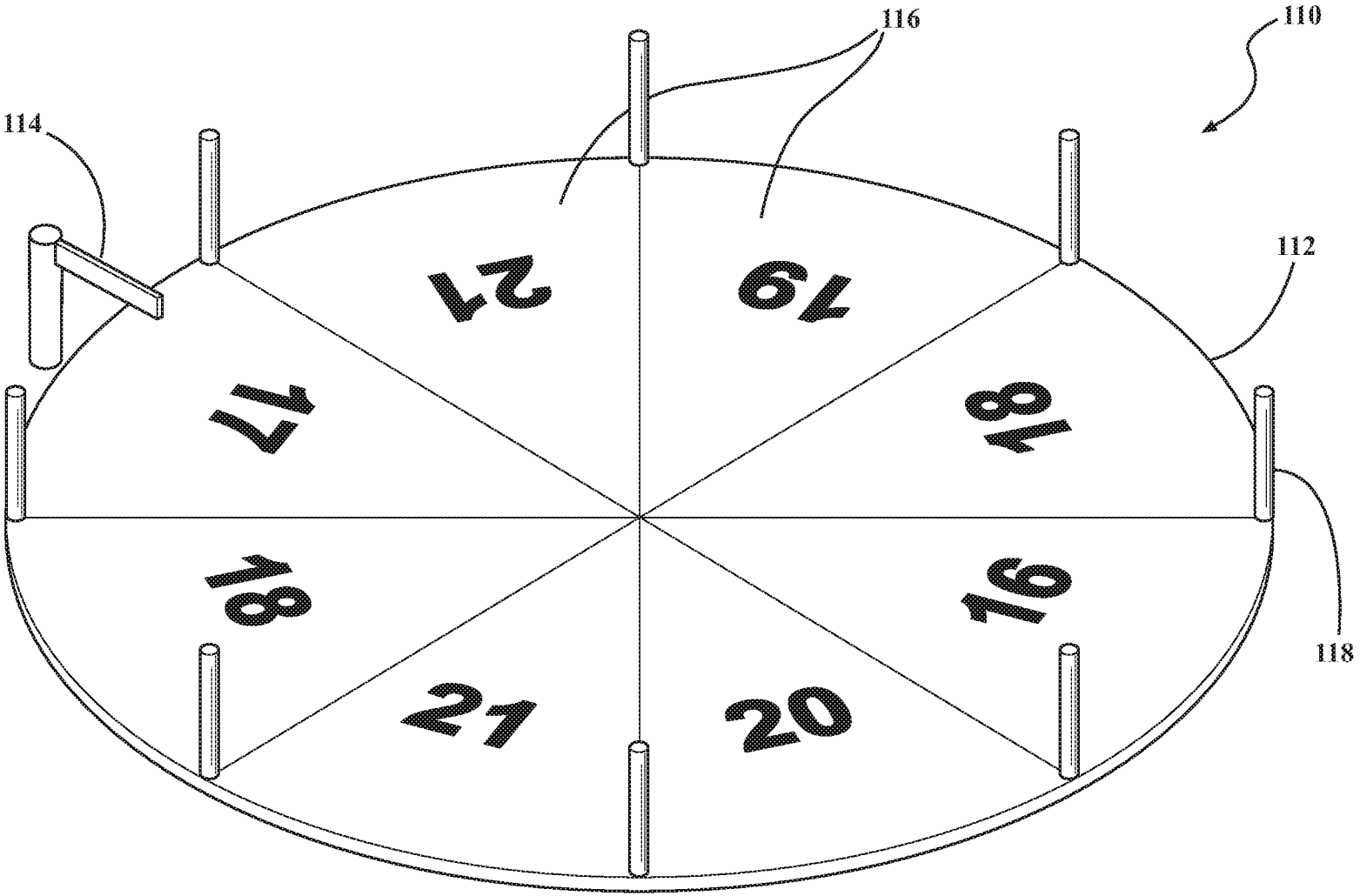
FIG. 3 is a perspective view of a second bonus wheel according to aspects of the disclosure.

An example of the roulette bonus bet system according to aspects of the disclosure is shown in FIGS. 1-3. The system may be used by a roulette dealer and/or a player of the roulette game (or other game, etc.) to place an additional bet on the outcome of the roulette game as will be described in conjunction with one or more exemplary embodiments. However, the specific example embodiments disclosed are merely provided to describe the inventive concepts, features, aspects and objectives with sufficient clarity to permit those skilled in this art to understand and practice the disclosure.

Roulette is a centuries-old game of chance that is believed to have originated in France. Typically, a player (not shown) places bets on a roulette table 10 (see, e.g., FIG. 1) as to whether a single number N (e.g., 1 to 36), groups of numbers G, colors R and B assigned to numbers N (e.g., red and black), whether the number is odd O or even E, or whether high H or low L will be the result of spin of a roulette wheel 12 with thirty-six pockets 14 (and an additional one or two for zero and/or double zero), and a roulette ball 16 spun in the opposite direction of the roulette wheel 12. The roulette ball 16 is spun by the dealer (not shown) in a track 18 located above the roulette wheel 12. As the roulette wheel 12 slows down, the roulette ball 16 also slows down and due to the effect of gravity, falls from the track 18 onto the roulette wheel 12, whereupon it bounces along the outer portion of the roulette wheel 12 that contains the pockets 14, each one assigned to a number N. The amount of numbers N on the roulette wheel 12 can vary, however the operation of the game is largely similar.

While roulette may be played solely for fun, typically roulette is played in a casino, involving players betting money on the outcome of each spin of the roulette wheel 12 and roulette ball 16. The dealer monitors and supervises the operation of the roulette game, especially the placing of bets by one or more players. As the number of players increase, it can be challenging for the dealer to keep track of operation of the game and the bets placed on the roulette table 10.

There are two types of roulette bets that players can place on the outcome of a spin of the roulette wheel 12 and roulette ball 16, an inside bet and an outside bet. There are a number of inside bets. For example, players can bet on a particular number (e.g., 5), called a straight or single bet. A bet placed on the number 5 (i.e., a chip or chips placed completely within the space denoted for the number 5), will only be a winning bet (and receive a payout from the casino), if the roulette ball lands in the pocket 14 assigned to the number 5 on the roulette wheel 12.

Another inside bet is a split bet. Players can bet on two vertically or horizontally adjacent numbers N on the roulette table 10. For example, players can bet on the numbers 1 and 2, which are vertically adjacent numbers N on the roulette table 10 as shown in FIG. 1 by placing a chip or chips on the edge (i.e., line, border), shared by the numbers 1 and 2.

Another inside bet is known as the street. Players can bet on three consecutive numbers N in a horizontal line on the roulette table 10. For example, players can bet on the numbers 1, 2 and 3, which are horizontally adjacent numbers N on the roulette table 10 as shown in FIG. 1 by placing a chip or chips on the outer edge of the number at either end of the number N at either end of the time (in this example, at the outer edge of 1 or 3).

Another inside bet is the corner or square bet. Players can bet on four numbers N that meet in one corner on the roulette table 10. For example, players can bet on the numbers 5, 6, 8, and 9, which share a common corner on the roulette table 10 as shown in FIG. 1 by placing a chip or chips on the common corner shared by the numbers 5, 6, 8, and 9.

Another inside bet is the six line or double street bet. Players can bet on six consecutive numbers N that form two horizontal lines on the roulette table 10. For example, players can bet on the numbers 16, 17, 18, 19, 20, and 21, which are in two adjacent horizontal rows on the roulette table 10 as shown in FIG. 1 by placing a chip or chips on the outer corner shared by the two leftmost or the two rightmost numbers N (in this example, 16 and 19, or 18 and 21).

Another inside bet is the trio bet. Players can bet on three numbers N that involve at least one zero Z on the roulette table 10. For example, players can bet on the numbers 0, 1, and 2 or 0-00-2 (only for the roulette table 10 and the roulette wheel 12 configuration with "00" or "double zero") on the roulette table 10 as shown in FIG. 1 by placing a chip or chips on the corner shared by the three numbers N (in this example, the corner shared by 0, 1, and 2 and the corner shared by 0, 00, and 2).

Still another inside bet is the basket or first four bet. Players can bet on the numbers 0, 1, 2, and 3 (only for a single-zero roulette table 10 and roulette wheel 12 configuration) on the roulette table 10. For example, players can bet on the numbers 0, 1, 2, and 3 on the roulette table 10 as shown in FIG. 1 by placing a chip or chips on the outer corner shared either by 0 and 1 or the outer corner shared by 0 and 3.

Another inside bet is the top line bet. Players can bet on the numbers 0, 00, 1, 2, and 3 (only for a double-zero roulette table 10 and roulette wheel 12 configuration) on the roulette table 10. For example, players can bet on the numbers 0, 00, 1, 2, and 3 on the roulette table 10 as shown in FIG. 1 by placing a chip or chips on the outer corner shared by 0 and 1 or on the outer corner shared by 00 and 3. Additional inside bets are also contemplated, the inside bets shown here are only exemplary and not limiting.

It will be appreciated that the illustrated roulette table and the arrangement of the numbers enabling the above exemplary inside bets may be different, such that different numerical arrangements are used on the table, thereby enabling bets for different groupings of numbers using similar placements to those described above (for example, placing a chip or marker on more than one number).

For bets in which more than one number are selected for the wager, the potential payout is reduced relative to betting a single number, as the odds for winning the bet are increased.

There are also a number of outside bets. A first outside bet is the 1 to 18 bet (i.e., low bet). Players can bet on the numbers 1 to 18 on the roulette table 10. For example, players can bet on the numbers 1 to 18 (including the number 1 and every number up to and including 18) on the roulette table 10 as shown in FIG. 1 by placing a chip or chips on the section of the roulette table 10 denoted as 1 to 18.

Another outside bet is the red or black bet. Players can bet that the number N will be a red number or a black number on the roulette table 10. For example, players can bet on the color red or black, respectively, on the roulette table 10 as shown in FIG. 1 by placing a chip or chips on the section of the roulette table 10 denoted as red or black.

Another outside bet is the even or odd bet. Players can bet that the number N will be an even or an odd number on the roulette table 10. For example, players can bet that the number N will be even or odd on the roulette table 10 as shown in FIG. 1 by placing a chip or chips on the section of the roulette table 10 denoted as even or odd.

Another outside bet is the dozen bet. Players can bet that the number N will be in the selected dozen (i.e., first dozen, second dozen, or third dozen). For example, players can bet that the number N will be in either the first dozen, second dozen, or third dozen on the roulette table 10 as shown in FIG. 1 by placing a chip or chips on the section of the roulette table 10 denoted for the first dozen, second dozen, or third dozen.

Another outside bet is the column bet. Players can bet that the number N will be in the selected vertical column of 12 numbers. For example, players can bet that the number N will be one of 1, 4, 7, through 34 on the roulette table 10 as shown in FIG. 1 by placing a chip or chips on the section of the roulette table 10 on the space below the final number (in this example, 34) in the columnar sequence.

Another outside bet is the snake bet. Players can bet that the number N will be in the unique configuration of numbers on the roulette table 10 that resemble a snake, hence the name snake bet. For example, players can bet that the number N will be one of 1, 5, 9, 12, through 30, 32, and 34 following a zig-zag pattern on the roulette table 10 as shown in FIG. 1 by placing a chip or chips on the section of the roulette table 10 at either the "head" or "tail" of a snake (in this example, as a snake is not shown, chips can be placed on the lower corner of the space for number 34). It should be noted that the snake bet is not always offered in all casinos, however. Additional outside bets are also contemplated, the inside bets shown here are only exemplary and not limiting.

There are corresponding payouts to each inside and outside bet in roulette. For example, the payout for a winning bet for single zero ("0"), double zero ("00"), and straight (i.e., any number N), are generally 35 to 1. The payout for a winning bet for row (0 or 00) and a split (i.e., any two adjoining numbers N, vertical or horizontal), are generally 17 to 1. The payout for a winning bet for a street (i.e., any three horizontal numbers N in a row), is generally 11 to 1. The payout for a winning bet for a corner (i.e., any four adjoining numbers N in a block), is 8 to 1. The payout for a winning bet for a top line or basket (0, 00, 1, 2, 3) is generally 6 to 1. The payout for a winning bet for a six line (i.e., any six numbers from two horizontal rows), is generally 5 to 1. The payout for a winning bet for a first column, second column, third column, first dozen, second dozen, or third dozen is generally 2 to 1. The payout for a winning bet for an even, odd, red, black, 1 to 18, and 19 to 36 is generally 1 to 1, respectively.

However, it will be appreciated that the payouts for each of the above bets may be different at different casinos, depending on demand, for example. However, the payouts will typically follow the above with respect to the relative payout for each type of bet, with the higher likelihood of winning corresponding to a lower payout.

As with the payouts for each bet, there are corresponding odds for each winning bet. At times, some or all of these odds may be printed on the roulette table 10. However, typically only some of the odds are printed on the roulette table 10 and some may be changed by the casino as desired. Under American roulette odds, the odds of a winning bet for single zero ("0"), double zero ("00"), and straight (i.e., any number N), are generally 37 to 1. The odds of a winning bet for row (0 or 00) and a split (i.e., any two adjoining numbers N, vertical or horizontal), are generally 18 to 1. The odds of a winning bet for a street (i.e., any three horizontal numbers N in a row), is generally 11 and ⅔ to 1. The odds of a winning bet for a corner (i.e., any four adjoining numbers N in a block), is generally 8 and ½ to 1. The payout for a winning bet for a top line or basket (0, 00, 1, 2, and 3) is generally 6 and ⅗ to 1. The odds of a winning bet for a six line (i.e., any six numbers from two horizontal rows), is generally 5 and ⅓ to 1. The odds of a winning bet for a first column, second column, third column, first dozen, second dozen, or third dozen is generally 2 and ⅙ to 1. The odds of a winning bet for an even, odd, red, black, 1 to 18, and 19 to 36 is generally 1 and 1/9 to 1. The dealer must be aware of the odds of all roulette bets in order to provide the odds to players if asked.

According to an aspect of the disclosure, additional betting options may be included in the roulette wheel 12, such as triple zero (000), a logo of the casino, or another betting option. It should be understood that including these additional betting options may affect the overall odds of the roulette game.

Typically, a casino can regulate the minimum and maximum amounts that players can bet (i.e., wager). These amounts can change over time and are important for the dealer to know and remember. Players can continue to bet as the roulette wheel 12 and roulette ball 16 are spinning, until the dealer tells the players "no more bets". In other situations, the dealer may state "no more bets" before spinning the roulette wheel 12 and the roulette ball 16. Once the roulette ball 16 has stopped moving on the roulette wheel 12 and ended up in a winning pocket 14, the roulette game is over and the dealer must remove the losing bets from the roulette table 10 to the casino and pay the winning bets to players, if any.

Referring now to FIG. 2, a non-limiting example of a bonus bet device 100 is shown and includes a bonus wheel 102, a pointer 104, and a plurality of roulette numbers 106 disposed about the perimeter of the bonus wheel 102. The bonus wheel 102 can include a plurality of pins (not shown), that engage the pointer 104 when the bonus wheel 102 is spun and are disposed on each side of each of the plurality of roulette numbers 106, such that the pointer 104 is disposed over one of the plurality of roulette numbers when the bonus wheel 102 is stationary. It should be understood that the bonus wheel 102 may be an actual roulette wheel 12 (as shown in FIG. 1), may be a representation of the roulette wheel 12 (including all or some of the numbers of the roulette wheel 12), or may be incorporated with the roulette wheel 12 (i.e., the roulette wheel 12 performs as the bonus bet device 100). Additionally and alternatively, the bonus wheel 102 may be configured as a display that electronically chooses a roulette number, or any other configuration that generates one or more results, such as, but not limited to, a dial, tumbler, dice, an electronic random/predetermined number generator, or a lottery-style number selector. Additionally and alternatively, the bonus wheel 102 may be configured to include a human element (e.g., a dart board), wherein the roulette number may be chosen as a result of a dart thrown at a dart board, for example. In other words, the bonus bet device may be configured as a representation of the game or as a contrasting representation. For example, a slot reel bonus bet device used with an actual roulette game, a craps roll bonus bet device used with an actual poker game, etc.

According to an aspect of the disclosure, the bonus bet device 100 may be used (i.e., spun), before or after the players have placed their bets on a pending game of roulette to be played on the roulette table 10 to increase the excitement and anticipation of the pending game of roulette (or another game). For example, the dealer, a player, or another bystander may spin the bonus wheel 102. If the result of the spin of the bonus wheel 102 is the number 30 (and the color red), any player that previously placed a bet on roulette table 10 for the number 30 and/or the color red receives an additional bonus. The additional bonus may be a monetary award, another prize, or a combination thereof, for example. Additionally and alternatively, the bonus may be a multiplication of the player's bet. For example, if the player bet $20 on the number 30 on the roulette table 10, since the result of the spin of the bonus wheel 102 was also the number 30, the player's winning may be multiplied by a predetermined factor, such as 2× or 3× the amount bet. Of course, if another player bet on the number 20 and the result of the spin of the bonus wheel 102 of the bonus bet device 100 was the number 30, the other player would not receive the bonus. Additionally and alternatively, the bonus may be a change in the payout and/or odds from 37 to 1 odds to 36 to 1, for example.

According to an aspect of the disclosure, additional betting options may be included in the bonus wheel 102 bonus bet device 100, such as triple zero (000), a logo of the casino, or another bonus bet option. It should be understood that including these additional bonus betting options may affect the overall odds of the bonus bet.

According to an aspect of the disclosure, the plurality of the roulette numbers 106 of the bonus wheel 102 may not equal the plurality of the roulette numbers of the roulette wheel 12. In other words, only a selection (i.e., a partial plurality), of the roulette numbers 106 may be provided on the bonus wheel 102. For example, only 12 numbers and/or colors may be provided on the bonus wheel 102. The elimination of the some of the roulette numbers 106 of the roulette wheel 12 on the bonus wheel 102 of the bonus bet device 100 may affect the odds of the remaining roulette numbers 106 coinciding with the result of a game of roulette on the roulette table 10. Additionally, the presence or absence of certain roulette numbers 106 on the bonus wheel 102 may affect the betting of the players on the game to be played on the roulette table 10. For example, a player, seeing that a particular roulette number 106 (e.g., red 30), on the bonus wheel 102, may choose to bet on that roulette number 106 rather than another roulette number 106. The player may even decide to bet more on that particular number due to the possibility of winning the bonus (and likewise may decline to bet on other roulette numbers 106 not present on the bonus wheel 102). In this way, the dealer (i.e., the casino), can influence the betting on particular roulette numbers 106 on the roulette table 10.

According to an aspect of the disclosure, the bonus wheel 102 may be configured as an electronic (i.e., digital) wheel. The bonus wheel 102 may be configured with one or more digital displays that project one or more images of roulette numbers 106. By configuring the bonus wheel 102 with a programmable digital display, the quantity of roulette numbers 106 (e.g., a few, some, or all), may be changed by the dealer, a predetermined program, and/or a random number generator. For example, the bonus wheel 102 may be configured to remain blank, or display other messages, enticements, or information about roulette. The bonus wheel 102 may display a portion of the roulette numbers 106 of the roulette wheel 12 about its perimeter and a manual and/or an electronic spin of the bonus wheel 102 determines which roulette number 106 and/or color of the portion is the bonus bet. For example, the bonus bet may be the roulette number 106 "30 and/or red". By configuring the roulette wheel with an electronic display, the roulette numbers 106 and/or colors can be changed for each roulette game. Additionally and alternatively, groups of roulette numbers 106, such as "odd" or "even" may replace or be used together with individual roulette numbers 106 on bonus wheel 102. As a result, a player that bet on the roulette number 106 "30/red" on the roulette table 10 will win the bonus bet if the subsequent spin of the bonus wheel 102 results in "red", "even", and/or the number 30, according to this example.

FIG. 3 illustrates another aspect of a second bonus bet device 110. The second bonus bet device 110 of FIG. 3 is in the form of a second bonus wheel 112 having a plurality of numbers 116 or other designations displayed thereon. The wheel 112, as illustrated in one aspect, includes eight sectors or numbers 116 that correspond to possible outcomes of a spin of the wheel 112. The bonus bet device 100 may further include a pointer 114 (or other outcome selection device) that is configured to ultimately point to or select the outcome at the conclusion of a spin or other outcome determination trial. In one aspect, a plurality of posts 118 extend from the wheel 112 at the perimeter of the device 110, with the pointer 114 configured to allow the wheel 112 to spin and the posts 118 to pass by the pointer 114 during the spin, such that when the wheel 112 comes to a stop after spinning, the pointer 114 is disposed circumferentially between adjacent posts 118. It will be appreciated that the illustrated wheel 112 is one example, and that additional sectors or numbers 116 may be included for a quantity greater than eight, or fewer sectors or numbers 116 may be included for a quantity less than eight. For purposes of discussion, the wheel 112 will be discussed in reference to the illustrated example of FIG. 3.

As shown in FIG. 3, the wheel 112 includes numbers ranging from 16-21. As described above, the wheel 102 may include fewer numbers than there are outcomes for the primary game being played. The wheel 112 of FIG. 3 is one example of that arrangement. Additionally, as shown in FIG. 3, the range of numbers 116 displayed on the wheel 112 includes six different numbers, but with eight different sectors. Accordingly, some of the numbers 116 are repeated on the wheel 112. As shown in FIG. 3, for example, the number "18" and the number "21" are displayed more than once. It will be appreciated that various arrangements where the range of numbers displayed does not correspond to the number of sectors or numbers 116. Four example, four different numbers may be distributed over eight sectors. It will further be appreciated that the amount of "repeat" numbers may vary. For example, one number may be printed on the wheel twice, three times, four times, etc.

For each of the various arrangements, the resulting odds of a particular number 116 being selected will depend on the number of times the number 116 is displayed on the wheel 112 and the number of outcomes available on the wheel 112. For example, if a specific number 116 is displayed twice on a wheel 112 having eight sectors, the odds of that specific number 116 being selected would be 25%. If a specific number 116 is displayed once on an eight-sector wheel 112, the odds would be 12.5%. Due to the possibility of different odds for different specific numbers 116, the resulting reward of winning the bonus bet may change. For example, if the odds of a particular outcome on the bonus bet device 100 are doubled relative to other outcomes, the reward for that particular outcome may be decreased, for example in half.

It will be appreciated that the displayed numbers 116 or symbols or other designations may be in a generally "permanent" or fixed form, such as being printed or painted on the device 110 in one aspect. In another aspect, the displayed numbers 116 or symbols or other designations may be in a "non-permanent" or variable form, such as in the form of a digital display, or a removable and replaceable indicia that may change the numbers 116 available to be bet.

As described above, the use of the bonus wheel 102/112 is in addition to the use of the traditional roulette wheel 12. The outcome determined on the bonus wheel 102/112 may therefore increase the payout associated with a corresponding bet on the traditional roulette wheel 12. However, the outcome determined on the bonus wheel 102/112 may not result in an increased payout (or bonus) in the event the wager on the traditional wheel 12 is unsuccessful, or if the successful wager on the traditional wheel does not correspond to the outcome of the bonus wheel 102/112. Accordingly, it may be desirable for wagers to be made prior to spinning the bonus wheel 102/112, and of course prior to the result of the traditional wheel 12 being determined.

However, in one aspect, the bonus wheel 102/112 may be spinned and an outcome of the bonus wheel 102/112 determined prior to closing off wagers for the primary wheel 12. In this aspect, players will know which outcomes have increased payouts or bonuses associated.

As described above, the arrangement of the various outcomes on the bonus wheel 102/112 may be selected to attempt to affect the betting for the roulette wheel 102. The presence of specific outcomes displayed on the wheel 102/112 may increase the frequency of bets made on those outcomes for the roulette wheel 102. Similarly, determining the outcome on the bonus wheel 102/112 prior to closing bets may cause additional bets to be made on the determined outcome of the bonus wheel 102/112. The dealer and/or casino operator may vary the time at which bets for the roulette wheel 12 are closed. For example, to increase interest at a certain time, bets may be allowed after the bonus wheel 102/112 outcome has been determined for a limited amount of time. It will be appreciated that other variations of when the bonus wheel outcome is determined may be used.

In one aspect, the bonus wheel 102/112 may be spun after the outcome of the roulette wheel 12 has been determined, but prior to payout for successful bets placed on the roulette wheel 12. For example, if the roulette wheel 12 determines the winning outcome to be "30," the bonus wheel 102/112 may then be spun to determine whether payouts to people that bet on "30" should be increased.

In one aspect, the bonus wheel 102/112 may be spun during the time that the roulette wheel 12 is spinning and the outcome of the roulette wheel 12 is unknown. At the conclusion of the determination of both spins, the payouts and potential bonus may be evaluated and distributed to the winners, which may or may not include bonuses.

In another aspect, wagering on the outcome of the bonus wheel 102/112 may also be permitted, either before or after wagering on the roulette wheel 12. For example, players may bet on the outcome of the bonus wheel 102/112. If a player successfully bets on the bonus wheel outcome, that player may receive an increased bonus relative to the traditional bonus. If that player loses the bet on the bonus wheel outcome, the player may be excluded from the traditional bonus, or the player may still be included in the traditional bonus.

The selection of a particular wager for the bonus bet devices 100/110 may be made in a manner similar to roulette wagering, where the player may place a chip or other marker (or other accepted indication of a wager) on a table or other mechanism where the available bets are indicated. The wager may similarly be made for more than one outcome, such as a single wager covering more than one number, as described above.

As described above, the wheel 12 or bonus wheel 102/112 may take on different forms. For example, the numbers or indicia on the wheels may be fixed, or be variable (such as in the form of a digital display or removable and replaceable indicia). It will also be appreciated that the wheels 12 or 102/112 may not be in the form of wheels that spin. Instead, the wheels 12 may be in the form of other random or variable outcome determination devices, such as rolling of dice, selection of cards, or the like. The outcome may be determined electronically, for example, similar to video blackjack or video poker or other electronic games of chance. It will be appreciated that a reference to an outcome determination device may therefore refer to the wheels described herein or may also refer to other forms of determining the outcome of a game of chance.

It should be understood that an aspect of the bonus bet system as disclosed herein may be applied to other casino-style games, such as card games, slot machines, video poker, or bingo. Additionally and alternatively, an aspect may be applied to other non-casino games, such as before sporting events (e.g., football, baseball), or before events within sporting events (e.g., whether a team scores a certain number of points, the performance of a particular player).

The foregoing disclosure has been described in accordance with the relevant legal standards, thus the description is exemplary rather than limiting in nature. Variations and modifications to the disclosed embodiment may become apparent to those skilled in the art and do come within the scope of the disclosure. Such variations are not to be regarded as a departure from the disclosure, and all such modifications are intended to be included within the scope of the disclosure. Those skilled in the art will recognize that concepts disclosed in association with an example enclosure assembly can likewise be implemented into many other systems to control one or more operations and/or functions. Accordingly, the scope of legal protection afforded this disclosure can only be determined by studying the following claims.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

What is claimed is:

1. A bonus bet system for use with a roulette game or other games of chance, the system comprising:

a first outcome display member having a first plurality of potential winning outcomes;

a first outcome determination member, the first outcome determination member configured to determine a winning outcome from the first plurality of potential winning outcomes;

a first wagering device, the first wagering device configured to receive wagers corresponding to one or more of the first plurality of potential winning outcomes;

a second outcome determination member, the second outcome determination member configured to determine a second outcome from a second plurality of potential outcomes;

wherein the second outcome determination member is separate from the first outcome determination member;

wherein the first plurality of potential winning outcomes includes at least the second plurality of potential outcomes;

wherein the winning outcome determined by the first outcome determination member provides a first payout corresponding to a wager received at the first wagering device that includes the winning outcome;

wherein the first payout is increased when the second outcome determined by the second outcome determination member includes at least the winning outcome;

wherein the second outcome determined by the second outcome determination member is only applicable to increase the first payout when the wager received at the first wagering device includes the winning outcome determined by the first outcome determination member, and wherein the first payout is increased without requiring additional wagering and outcome determination following the determination of the winning outcome and the second outcome.

2. The system of claim 1, wherein the first outcome display member is a first wheel.

3. The system of claim 2, further comprising a second outcome display member, wherein the second outcome display member is a second wheel.

4. The system of claim 3, wherein the first wheel includes a first plurality of colors and numbers displayed thereon, wherein the first plurality of potential outcomes includes the plurality of colors and numbers.

5. The system of claim 4, wherein the second wheel includes a second plurality of colors and numbers displayed thereon, where the second plurality of potential outcomes is the second plurality of colors and numbers, and the second plurality of potential outcomes is the same as the first plurality of potential outcomes.

6. The system of claim 4, wherein the second wheel is separate from the first wheel and rotates about a separate axis of rotation and includes a second plurality of colors and numbers displayed thereon, where the second plurality of potential outcomes is the second plurality of colors and numbers, and the second plurality of potential outcomes is different than the first plurality of potential outcomes, wherein some of the first plurality of potential outcomes are excluded from the second plurality of potential outcomes.

7. The system of claim 4, wherein the first plurality of colors and numbers includes a first range of numbers, and the second plurality of potential outcomes includes a second range of numbers that is less than the first range of numbers.

8. The system of claim 2, wherein the second outcome determination member is disposed on the first wheel.

9. The system of claim 8, wherein the second outcome determination member is a pointer configured to point to an outcome displayed on the first wheel.

10. The system of claim 1, wherein the first wagering device is a table including a display of the first plurality of potential outcomes.

11. The system of claim 1, wherein a payout for the winning outcome remains the same when the second outcome does not include the winning outcome.

12. The system of claim 1, wherein the second outcome is determinable prior to the winning outcome.

13. The system of claim 1, wherein the first plurality of potential outcomes is variable, and the first outcome display member includes a variable display of the first plurality of potential outcomes.

14. A method of determining a payout for a roulette game or a game of chance, the method including the steps of:

providing a first wagering device, the first wagering device having a first plurality of potential outcomes displayed thereon;

receiving a first wager from a player at the first wagering device, wherein the first wager includes one or more of the first plurality of potential outcomes;

determining a winning outcome via a first outcome display member and a first outcome determination member, wherein the first outcome display member includes the first plurality of potential outcomes, wherein the winning outcome corresponds to one of the first plurality of potential outcomes;

determining a second outcome via a second outcome determination member, wherein the second outcome determination member determines the second outcome from a second plurality of potential outcomes, wherein the second outcome corresponds to at least one of the second plurality of potential outcomes;

wherein the second outcome determination member is separate from the first outcome determination member and the winning outcome is determined independently from the second outcome via the first and second outcome determination members;

wherein the first plurality of potential outcomes includes at least the second plurality of potential outcomes;

determining whether the first wager corresponds to the winning outcome;

determining whether the second outcome corresponds to the winning outcome;

providing a first payout to a player when the first wager corresponds to the winning outcome;

increasing the first payout to the player when the second outcome corresponds to the winning outcome, wherein the first payout is increased without additional wagering and outcome determination following the determination of the winning outcome and the second outcome;

wherein the second outcome is only applicable to increase the first payout when the first wager corresponds to the winning outcome.

15. The method of claim 14, wherein the second plurality of potential outcomes is a subset of the first plurality of potential outcomes, and the second plurality of potential outcomes are provided on a second outcome display member that is separate from the first outcome display member and rotates about a different axis, wherein the second outcome determination member determines the outcome on the second outcome display member and the first outcome determination member determines the outcome on the first outcome determination member.

16. The method of claim 14, wherein the first outcome display member is a first wheel having the first plurality of potential outcomes displayed thereon and the second outcome determination member determines the second outcome on a second wheel having the second plurality of potential outcomes displayed thereon.

17. The method of claim 16, wherein the first and second wheel are the same wheel.

18. The method of claim 14, wherein the second plurality of potential outcomes includes one or more outcomes that occur more often.

19. The method of claim 14, wherein the first wager is received after determining the second outcome.

20. The method of claim 14, where the second outcome is determined prior to determining the winning outcome.

* * * * *